United States Patent [19]

Wood

[11] 4,044,415

[45] Aug. 30, 1977

[54] SURFBOARD LEASH

[76] Inventor: Bruce G. Wood, 4943½ Cape May Ave., San Diego, Calif. 92107

[21] Appl. No.: 675,732

[22] Filed: Apr. 12, 1976

[51] Int. Cl.[2] ..... A63C 15/06

[52] U.S. Cl. ..... 9/310 E; 267/69

[58] Field of Search ..... 9/310 E, 310 A, 310 AA, 9/310 R, 311, 314; 115/6.1, 70; 267/69; 119/96; 24/DIG. 4, DIG. 18

[56] References Cited

U.S. PATENT DOCUMENTS

| | | | |
|---|---|---|---|
| 1,638,073 | 8/1927 | Van Heusen | 24/DIG.18 |
| 2,117,322 | 5/1938 | Hillman | 267/69 |
| 3,372,438 | 3/1968 | Rinecker | 24/DIG. 18 |
| 3,802,011 | 4/1974 | Castagnola | 9/310 E |
| 3,931,656 | 1/1976 | Thomson | 9/310 E |

*Primary Examiner*—Trygve M. Blix
*Assistant Examiner*—Stuart M. Goldstein
*Attorney, Agent, or Firm*—Ralph S. Branscomb

[57] ABSTRACT

The invention is a leash which attaches to a surfboard at one end and to the surfer's ankle by means of a novel Velcro sandwich-type strap structure at the other end, the leash comprising two separable sections one of which includes an elongated length of elastic tubing through which passes a length of cord which is fixed at the ends of the tubing and is coiled somewhat inside the cord such that the elastic will stretch to a certain extent until it is stopped by the cord, the other section of the leash comprising a stronger section of tubing having no cord inside to provide a resilient buffer when the slack is taken up in the line within the first tubing.

3 Claims, 6 Drawing Figures

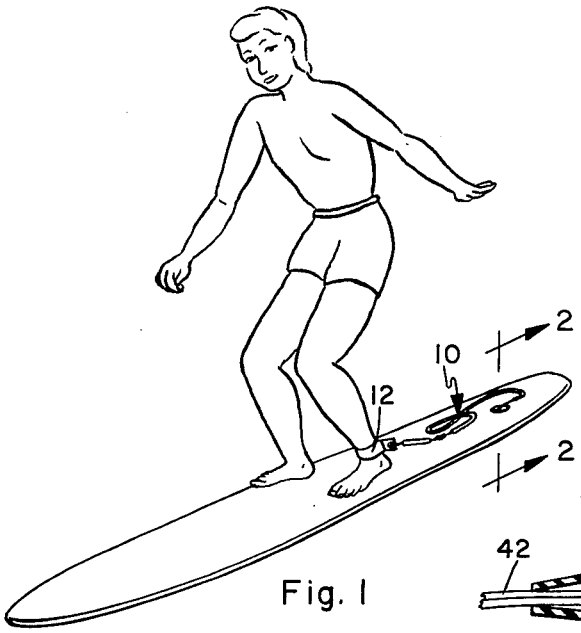
Fig. 1
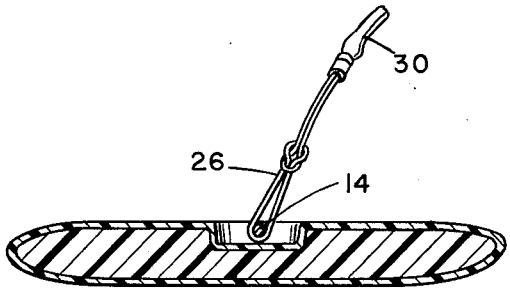
Fig. 2
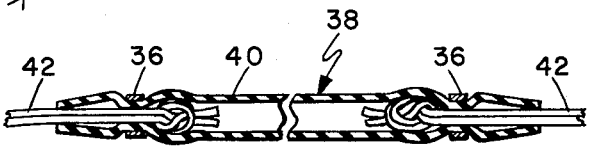
Fig. 4
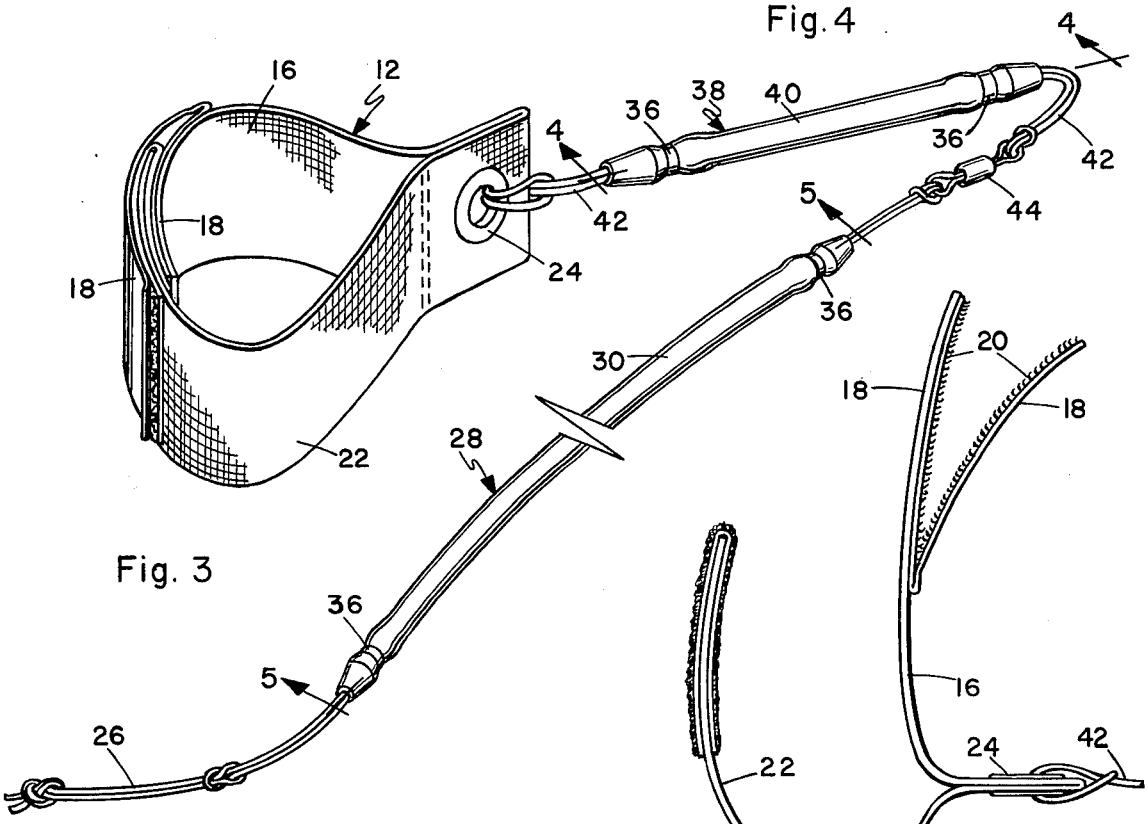
Fig. 3
Fig. 6
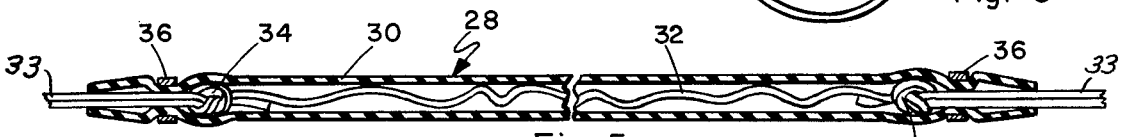
Fig. 5

SURFBOARD LEASH

BACKGROUND OF THE INVENTION

In the sport of surfing, up until a few years ago, when a surfer was separated for his board in the surf, the surfer would remain about where he fell but the board would careen through the water under wave action until it reached the beach. This was undesirable for two obvious reasons, the first being the danger to bathers in the area which is considerable if the beach is crowded, and the second being the inconvenience to the surfer who would almost without fail have to swim the entire distance to the beach to recover his board.

The difficulties lead to the invention of the surfboard leash which connects the surfer's ankle to the board, making the surfer something like a sea anchor restraining the board when he falls off. Although leashes have become more sophisticated since the initial development, it is still quite common for them to age and eventually break, particularly if they include a length of soft elastic to avoid jolting the surfer when the board reaches the end of the leash.

SUMMARY OF THE INVENTION

The present invention is a surfboard leash designed to avoid the unpleasant jolt delivered to both the surfer and the board by an inelastic leash but at the same time provides sufficient strength to avoid premature breaking of the leash. These ends are accomplished by incorporating in the leash two elastic segments, both including elastic tubing and the first being a length of tubing through which passes a length of cord which is knotted just inside the tubing ends and secured in this position by means of continuous metal rings. The cord within the tube is somewhat coiled and longer than the unstretched length of the tube so that upon applying tension the tube is first stretched unimpeded by the cord, and upon the cord straightening, no further stretching of the tube is possible and thus the life of this tubing member tends to be extended.

However, although the tubing with the cord inside is satisfactory during mild surfing conditions, it is not adequate for the severe shocks and jolts that occasionally are experienced by the leash when a powerful wave catches the board broadside, for example. Under these conditions, it is common for the leash to part, although for mild conditions, the resilience of the tubing creates an ideal leash.

Thus, so that the leash may be ideal for both rough and mild conditions, a second, more durable and elastically stronger length of tubing has been incorporated in the leash such that upon the arrival of the first tubing member at its length of maximum extension, the second tube will take over and provide enough elasticity to prevent the separating of the leash.

To ensure that the strap engaging a surfer's ankle is of sufficient strength, a sandwich or tongue-and-groove-type Velcro construction is incorporated in the ankle grip.

BRIEF DESCRIPTION OF THE DRAWINGS

FIG. 1 illustrates the tether in use with a surfboard;

FIG. 2 is a sectional view taken on line 2—2 of FIG. 1;

FIG. 3 is an enlarged perspective view of the tether;

FIG. 4 is an enlarged sectional view taken on line 4—4 of FIG. 3;

FIG. 5 is an enlarged sectional view taken on line 5—5 of FIG. 3; and

FIG. 6 is a top plan view of the ankle strap in open position.

BRIEF DESCRIPTION OF THE PREFERRED EMBODIMENT

The general mode of use of the leash is indicated in FIG. 1 wherin the leach 10 is attached by means of an ankle strap 12 to a surfer, the other end of the leach being attached to the surfboard by virtue of a small bar 14 provided for this purpose, or the leash may be attached to the skeg. The ankle strap is shown in detail in FIGS. 3 and 6 and incorporates a first strap 16 which has divergent ends 18 which are lineed with Velcro material 20 as best seen in FIG. 6. A second strap 22 is joined to the first strap, or may be an extension thereof, and by means of an eyelet 24 or other suitable structure is connected to the leash. The second strap is also coated with Velcro material such that the first and second strap represent the male and female Velcro connector materials, respectively.

As can be seen from FIG. 6, the end of the second strap 22 is interstitially received between the double ends 18 of the first strap to form a sandwich-like double Velcro connection to ensure that the leash does not separate from the surfer's ankle which has been a problem using two simple Velcro straps in the conventional fashion.

A small loop of cord 26 may be used at the other end of the leash to engage the bar 14.

The leash itself comprises essentially two sections, the first, generally indicated at 28, constituting a length of tubing 30 which is made of rubber but could be made of any elastic substance. Passing through the center of tubing is a cord 32 which has loops 33 extending from each end of the tubing 30, the cord being knotted, as indicated at 34 in FIG. 5, just within the ends of the tubing 30. A pair of rings 36 are inserted over the tapered ends of the tubing as indicated best in FIG. 5 to securely engage the knots of the cord within the tube. It can be seen that enough of the cord is enclosed in the tubing so that in the relaxed state of the tube as shown in FIG. 5, a considerable amount of slack exists in the cord so that upon tensioning the cord from the outside, the tube will stretch freely until a certain extended length is reached, at which point the cord will have become taut and the stretching will cease.

The first portion of the tubing thus cushions the tensioning shock felt by the surfer and his board and is adequate under normal circumstances to prevent undue loads on the leash. However, any devotee to the sport of surfing has experienced periodically falls and the consequent shock on the leash line that would instantaneously extend the tubing 30 to its maximum allowed length with the result that little or no cushioning is provided and the leash is subject to parting. To avoid this, a second portion of the leash 38 is provided, this second portion comprising a shorter length of tubin 40 which is of much greater elastic strength or "stiffer" than the first tube. This tube has a pair of loops 42 included at the ends, and retained by the knot and ring method shown in FIG. 5 The second portion 38 and the first section 28 of the leash are connected to each other through a swivel 44 which serves the obvious purpose of preventing the line from accumulating kinks or twists. With the addition of the second tubing portion, it is clear that upon extension of the first tubing to its limit, the second tube will take over and provide some degree of resilience in the line to both prevent it from snapping and ease the strain on the surfer's ankle and the surfboard connection.

By virtue of the simple construction utilizing loops extending from each of the tubes, manufacture can be done separately for each section and replacement of any worn parts can also be done separately, and any rearrangement of the parts desired by a particular surfer can be accomplished by a simple rearrangement of the sections by disengaging the loops.

I claim:

1. An ankle leash for securing a surfboard to a surfer comprising:

a. an elongated line having means at each end to engage a surfer's ankle and a surfboard, respectively;

b. a first portion of said line being elastic and capable of stretching from a first length to a second length and being substantially inextensible beyond said second length;

c. a second portion of said line being elastic and of elastic strength greater than that of said first portion;

d. the first portion of said line including a first length of elastic joined at both ends to a length of essentially inextensible cord, the portion of said length of cord between the ends of said elastic being longer than the unstretched length of said elastic whereby upon tensioning said line, said first elastic, said cord, and said second portion of said line are tensioned in that order; and e. said second portion of said line comprising a tube and said line includes cord portions entering each end of said tube and having knotted ends disposed within said tube and including retaining rings disposed on said tube outside of said knots to retain said knotted ends within said tube.

2. An ankle leash for securing a surfboard to a surfer comprising:

a. an elongated line having means at each end to engage a surfer's ankle and a surfboard, respectively;

b. a first portion of said line being elastic and capable of stretching from a first length to a second length and being substantially inextensible beyond said second length;

c. a second portion of said line being elastic and of elastic strength greater than that of said first portion; and d. said first and second line portions each comprise an elastic tube having cord loops securely connected within and extending from each of the ends thereof, said loops releasably connecting said portions to each other and to said means to engage the surfer's ankle and the surfboard.

3. Structure according to claim 2 wherein said means to engage a surfer's ankle comprises a pair of straps joined at one end to one end of said line, the free end of one of said straps diverging into two end pieces which receive interstitially the free end of the other of said straps, each of said free strap ends being covered with Velcro material whereby a durable and releasable sandwich-like Velcro bond is effected therebetween such that a surfer's ankle can be securely engaged between said straps.

* * * * *